US010522908B2

(12) United States Patent
Wu et al.

(10) Patent No.: US 10,522,908 B2
(45) Date of Patent: Dec. 31, 2019

(54) ANTENNA CONTROL METHOD

(71) Applicant: PEGATRON CORPORATION, Taipei (TW)

(72) Inventors: Chien-Yi Wu, Taipei (TW); Chao-Hsu Wu, Taipei (TW); Ya-Jyun Li, Taipei (TW); Shih-Keng Huang, Taipei (TW); Yu-Yi Chu, Taipei (TW)

(73) Assignee: PEGATRON CORPORATION, Taipei (TW)

( * ) Notice: Subject to any disclaimer, the term of this patent is extended or adjusted under 35 U.S.C. 154(b) by 0 days.

(21) Appl. No.: 16/423,345

(22) Filed: May 28, 2019

(65) Prior Publication Data

US 2019/0280381 A1 Sep. 12, 2019

Related U.S. Application Data

(62) Division of application No. 15/600,786, filed on May 21, 2017, now Pat. No. 10,355,353.

(30) Foreign Application Priority Data

Jul. 21, 2016 (TW) ..... 105123087 A

(51) Int. Cl.

| | |
|---|---|
| ***H01Q 3/24*** | (2006.01) |
| ***H01Q 9/04*** | (2006.01) |
| ***H01Q 5/371*** | (2015.01) |
| ***H01Q 5/378*** | (2015.01) |

(52) U.S. Cl.

CPC ..... *H01Q 3/242* (2013.01); *H01Q 5/371* (2015.01); *H01Q 5/378* (2015.01); *H01Q 9/0421* (2013.01)

(58) Field of Classification Search

CPC ..... H01Q 3/242; H01Q 5/378; H01Q 5/371; H01Q 9/0421

See application file for complete search history.

(56) References Cited

U.S. PATENT DOCUMENTS

| | | | |
|---|---|---|---|
| 6,662,028 | B1 | 12/2003 | Hayes et al. |
| 2004/0075610 | A1 | 4/2004 | Pan |
| 2005/0088342 | A1 | 4/2005 | Parsche |

(Continued)

FOREIGN PATENT DOCUMENTS

| | | | |
|---|---|---|---|
| TW | I485927 | B | 5/2015 |
| TW | I487197 | B | 6/2015 |
| WO | 2014077951 | A1 | 5/2014 |

*Primary Examiner* — Hai V Tran
*Assistant Examiner* — Awat M Salih
(74) *Attorney, Agent, or Firm* — McClure, Qualey & Rodack, LLP

(57) ABSTRACT

An antenna unit, an antenna system and an antenna control method are disclosed. The antenna unit includes a first radiation metal element, a second radiation metal element, and a third radiation metal element. The first radiation metal element includes a signal feed point, a first ground point, and a second ground point. The signal feed point, the first ground point, and the second ground point are disposed approximately in a straight line. The second radiation metal element is disposed away from the first radiation metal element with a gap and includes a third ground point. The third radiation metal element surrounds the first radiation metal element and the second radiation metal element and includes a fourth ground point.

4 Claims, 5 Drawing Sheets

(56) References Cited

U.S. PATENT DOCUMENTS

| | | | | |
|---|---|---|---|---|
| 2005/0176374 | A1* | 8/2005 | Fang | H04B 7/0691 455/63.4 |
| 2007/0182619 | A1* | 8/2007 | Honda | G01S 13/931 342/80 |
| 2010/0117922 | A1 | 5/2010 | Fukuda | |
| 2011/0241953 | A1 | 10/2011 | Su | |
| 2011/0274146 | A1 | 11/2011 | Huang et al. | |
| 2012/0249396 | A1 | 10/2012 | Parsche | |
| 2013/0335293 | A1* | 12/2013 | Zhang | H01Q 3/242 343/876 |
| 2014/0313089 | A1 | 10/2014 | Wu et al. | |
| 2014/0347241 | A1 | 11/2014 | Kim et al. | |
| 2015/0078488 | A1* | 3/2015 | Lee | H04B 7/0691 375/316 |
| 2015/0340770 | A1 | 11/2015 | Loh et al. | |
| 2016/0043473 | A1 | 2/2016 | Walker | |
| 2016/0148752 | A1 | 5/2016 | Moon et al. | |
| 2016/0189915 | A1 | 6/2016 | Kim et al. | |
| 2017/0214147 | A1* | 7/2017 | You | H01Q 15/14 |
| 2017/0301989 | A1* | 10/2017 | Wu | H01Q 3/34 |

* cited by examiner

ANTENNA CONTROL METHOD

RELATED APPLICATIONS

This application is a Divisional Application of U.S. application Ser. No. 15/600,786 filed May 21, 2017, which claims priority to Taiwan Application Serial Number 105123087, filed Jul. 21, 2016, which is herein incorporated by reference.

BACKGROUND

Technology Field

The present disclosure relates to an antenna. More particularly, the present disclosure relates to a high-directivity multi-frequency antenna control method.

Description of Related Art

Beam-switching antennas are usually designed in a form of a dipole antenna architecture. However, a dipole antenna is an omni-directional antenna, and multiple dipole antennas will interfere with one another. In addition, the beam switching antennas in the dipole antenna architecture have a poorer signal quality in one certain polarization direction and have a bulky size, which is disadvantageous to a trend of shrinking sizes of electronic devices recently. As a result, miniaturized antenna systems having a high-directivity radiation pattern are currently one of the important development directions in the field of the communication technology.

SUMMARY

An antenna unit is provided. The antenna unit comprises a first radiation metal element, a second radiation metal element, and a third radiation metal element. The first radiation metal element comprises a signal feed point, a first ground point, and a second ground point. Positions of the signal feed point, the first ground point, and the second ground point are arranged approximately in a straight line. The second radiation metal element is disposed away from the first radiation metal element with a gap and comprises a third ground point. The third radiation metal element surrounds the first radiation metal element and the second radiation metal element and comprises a fourth ground point.

The present disclosure provides an antenna system. The antenna system comprises a plurality of antenna units. Each of the antenna units has a directional radiation pattern, and the antenna units are disposed to surround a center point and each of the a directional radiation patterns extends from the center point towards an outside. Each of the antenna units comprises a first radiation metal element, a second radiation metal element, and a third radiation metal element. The first radiation metal element comprises a signal feed point, a first ground point, and a second ground point. Positions of the signal feed point, the first ground point, and the second ground point are arranged approximately in a straight line. The second radiation metal element is disposed away from the first radiation metal element with a gap and comprises a third ground point. The third radiation metal element surrounds the first radiation metal element and the second radiation metal element and comprises a fourth ground point.

The present disclosure further provides an antenna control method. The antenna control method is for the above antenna system. The antenna control method comprises the following steps: controlling an on/off state of each of the antenna units to switch among a plurality of antenna unit configurations; detecting a signal intensity of each of the antenna unit configurations; determining one of the antenna unit configurations having an optimized signal intensity based on a detection result; and using the one of the antenna unit configurations to receive or transmit signals.

According to the present disclosure, the antenna unit has the characteristics of small size, small back radiation, etc., and can also have the characteristics of transmitting and receiving frequency bands of the 2.4G Wi-Fi antenna and the 5G Wi-Fi antenna. In addition, the antenna unit can further allow the antenna pattern of the 2.4G Wi-Fi antenna that is originally an omni-directional radiation pattern to have the effect of forward radiation or even high directivity. The antenna system and antenna control method disclosed by the present application can allow the electronic device to maintain the optimized signal receiving and transmitting ability at all times.

It is to be understood that both the foregoing general description and the following detailed description are by examples, and are intended to provide further explanation of the invention as claimed.

BRIEF DESCRIPTION OF THE DRAWINGS

This disclosure can be more fully understood by reading the following detailed description of the embodiment, with reference made to the accompanying drawings as follows.

DESCRIPTION OF THE EMBODIMENTS

Reference will now be made in detail to the present embodiments of the disclosure, examples of which are illustrated in the accompanying drawings. However, the embodiments provided herein are intended as illustrative only since numerous modifications and variations therein will be apparent to those skilled in the art. Description of the operation does not intend to limit the operation sequence. Any structures resulting from recombination of elements with equivalent effects are within the scope of the present disclosure. In addition, drawings are only for the purpose of illustration and not plotted according to the original size.

Figure 1A:
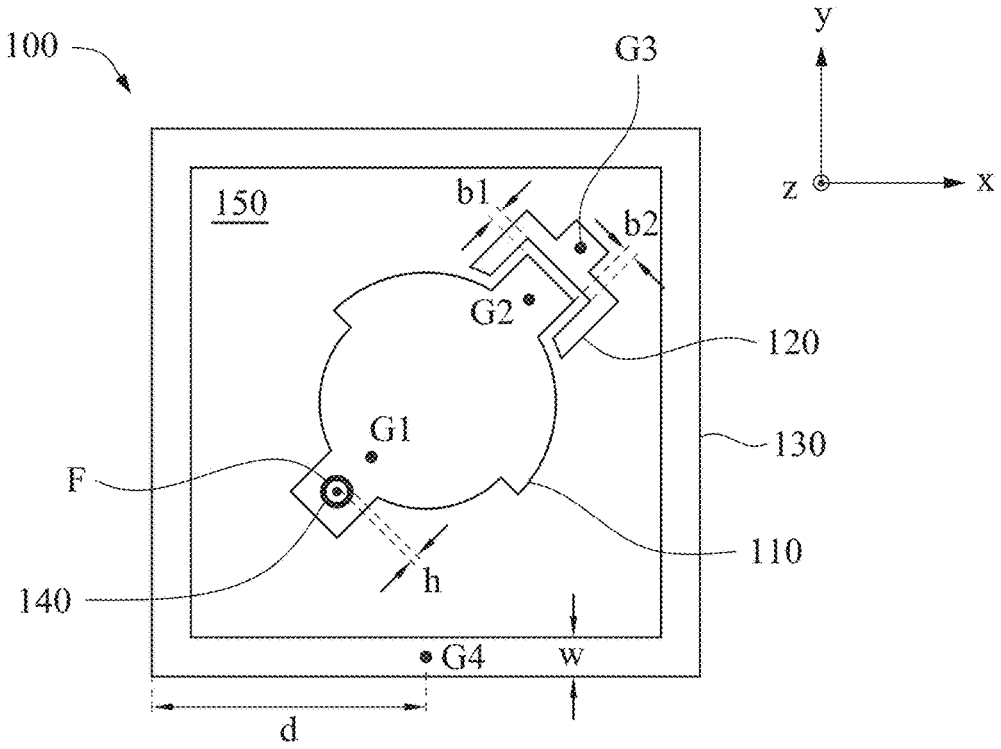
FIG. 1A depicts a top view of an antenna unit according to one embodiment of the present disclosure.
Figure 1B:
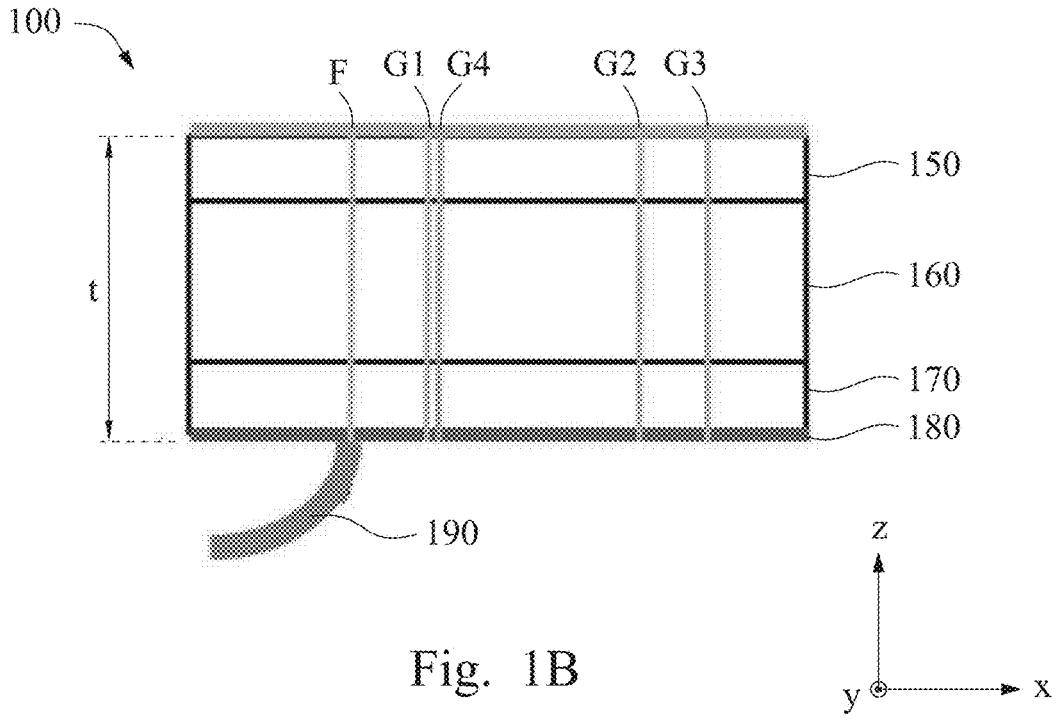
FIG. 1B depicts a side view of an antenna unit according to one embodiment of the present disclosure.

A description is provided with reference to FIG. 1A and FIG. 1B. FIG. 1A and FIG. 1B respectively depict a top view and a side view of an antenna unit 100 according to one embodiment of the present disclosure. The antenna unit 100 is, for example, a panel antenna unit. In greater detail, a volume size is, for example, 35 mm×35 mm×8 mm. As seen from the top view of FIG. 1A, a body of the antenna unit 100 has a first radiation metal element 110, a second radiation metal element 120, and a third radiation metal element 130. As seen from the side view of FIG. 1B, the antenna unit 100 is constituted by a top body, a first substrate 150, a second substrate 160, a third substrate 170, and a bottom ground plane 180.

The first substrate 150 is configured to carry the first radiation metal element 110, the second radiation metal element 120, and the third radiation metal element 130 of the body of the antenna unit 100. The first substrate 150, the second substrate 160, and the third substrate 170 are collectively a dielectric support of the antenna unit 100. In addition, a bottom side of the third substrate 170 is connected to the ground plane 180. A total thickness t of the first substrate 150, the second substrate 160, and the third substrate 170 is, for example, 8 mm. The ground plane 180 is configured to form coupling resonance with the first radiation metal element 110, the second radiation metal element 120, and the third radiation metal element 130 of the antenna unit 100. The first substrate 150, the second substrate 160, and the third substrate 170 are all dielectric materials. Although the first substrate 150, the second substrate 160, and the third substrate 170 are formed by a combination of three individual substrates in FIG. 1B, the present disclosure is not limited in this regard. In applications, the first substrate 150, the second substrate 160, and the third substrate 170 may also be integrally formed as a single dielectric support.

As mentioned above, the first radiation metal element 110, the second radiation metal element 120, and the third radiation metal element 130 are disposed on the first substrate 150. The first radiation metal element 110 has a signal feed point F, a first ground point G1, and a second ground point G2. The signal feed point F is electrically coupled to a positive terminal of a coaxial transmission line 190 of a signal transceiver (not shown) and is configured to transmit an antenna transmitting and receiving signal. The first ground point G1 and the second ground point G2 are electrically coupled to a negative terminal of the coaxial transmission line 190 of the signal transceiver, respectively, and are connected to the ground plane 180. Positions of the signal feed point F, the first ground point G1, and the second ground point G2 can be arranged approximately in a straight line. The approximate straight line indicates a line that may have curves or angles generally accepted in practical applications.

Since the thickness t of the first substrate 150, the second substrate 160, and the third substrate 170 will cause the antenna unit 100 to have a higher inductance, a slot 140 is disposed around and at a distance h from the signal feed point F. A capacitive character of the slot 140 is used to adjust impedance matching of the antenna unit 100. In the present embodiment, a radius of the signal feed point F is, for example, 1 mm, and the distance h is, for example, 0.5 mm.

Figure 2:
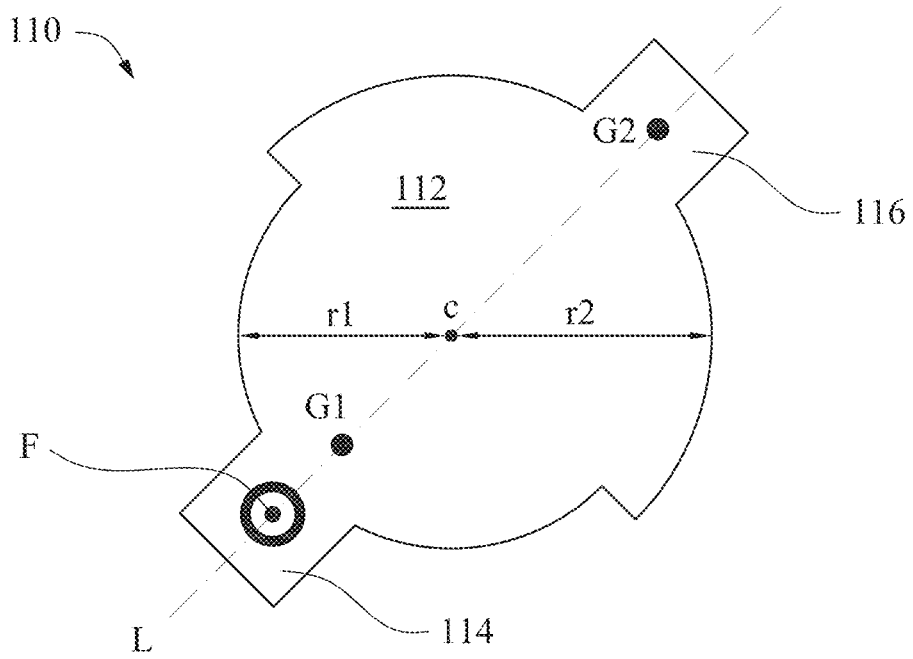
FIG. 2 depicts a top view of part of an antenna unit according to one embodiment of the present disclosure.

A detailed structure of the first radiation metal element 110 is shown in FIG. 2. FIG. 2 depicts a top view of the first radiation metal element 110 of the antenna unit 100 according to one embodiment of the present disclosure. The first radiation metal element 110 is divided into a first metal part 112, a second metal part 114, and a third metal part 116. According to the present embodiment, the first metal part 112 is formed by a combination of a semicircle of radius r1 and a semicircle of radius r2. The radius r1 may be the same as or different from the radius r2 and they are designed depending on practical applications. It is noted that a shape of the first radiation metal element 110 is not limited to a combination of circle-like shapes or semicircles, which may be any geometrically symmetrical shape.

The second metal part 114 is connected to one side of the first metal part 112 on the semicircle with radius r1, the third metal part 116 is connected to one side of the first metal part 112 on the semicircle with radius r2, and a position of the third metal part 116 is opposite to that of the second metal part 114, as shown in FIG. 2. The signal feed point F is disposed on the second metal part 114. The first ground point G1 may be disposed on the second metal part 114 or on the first metal part 112 adjacent to the second metal part 114, and the second ground point G2 may be disposed on the third metal part 116 or on the first metal part 112 adjacent to the third metal part 116. The positions of the signal feed point F, the first ground point G1, and the second ground point G2 form a straight line L. The first metal part 112, the second metal part 114, and the third metal part 116 are mirror-symmetric with respect to the straight line L.

In the present embodiment, a distance between the signal feed point F and a center point c of the first metal part 112 is, for example, approximately 11.5 mm. A distance between the first ground point G1 and the center point c is, for example, approximately 5.25 mm, and a distance between the second ground point G2 and the center point c is, for example, approximately 11.5 mm. Through the connection of the first ground point G1 with the ground plane 180, the antenna unit 100 can resonate, for example, a resonant frequency (2400 MHz to 2500 MHz) of a 2.4G Wi-Fi antenna. Through the connection of the second ground point G2 with the ground plane 180, the antenna unit 100 can resonate, for example, a resonant frequency (5100 MHz to 5875 MHz) of a 5G Wi-Fi antenna. Hence, the antenna unit 100 has the capability of transmitting and receiving a 2.4G Wi-Fi signal and a 5G Wi-Fi signal at the same time.

A resonant frequency of 2.4G Wi-Fi is approximately determined by an area of the first metal part 112, and a resonant frequency of 5G Wi-Fi is approximately determined by a length of the first radiation metal element 110 along the straight line L (e.g., a total length of the first metal part 112, the second metal part 114, and the third metal part 116 along the straight line L). The resonant frequency position and impedance bandwidth of 2.4G Wi-Fi can be adjusted by changing the position of the first ground point G1 on the semicircle of radius r1 or the second metal part 114 along the straight line L. The resonant frequency position and impedance bandwidth of 5G Wi-Fi can be adjusted by changing the position of the second ground point G2 on the semicircle of radius r2 or the third metal part 116 along the straight line L.

With additional reference to FIG. 1A, the second radiation metal element 120 is a quarter-wave U-shaped metal sheet, and adjacent to the first radiation metal element 110 with gaps b1 and b2 so as to be capacitively coupled to an end of the first radiation metal element 110 (the third metal part 116). In the present embodiment, the gap b1 is, for example, 0.7 mm, the gap b2 is, for example, 0.5 mm. However, the present disclosure is not limited in this regard. The gaps b1, b2 may be adjusted depending on practical applications to achieve suitable coupling effects.

The second radiation metal element 120 has a ground point G3. Similar to the ground points G1 and G2, the ground point G3 is also connected to the ground plane 180 on the bottom. Generally speaking, 2.4G Wi-Fi has an omni-directional radiation pattern. However, by capacitively coupling the second radiation metal element 120 with the first radiation metal element 110, the radiation pattern of 2.4G Wi-Fi of the antenna unit 100 can have the characteristic of forward radiation, and the forward radiation pattern of 5G Wi-Fi is also maintained at the same time. That is, not only can the antenna unit 100 disclosed by the present application have the capability of transmitting and receiving the 2.4G Wi-Fi signal and the 5G Wi-Fi signal at the same time, but the antenna unit 100 also has the radiation patterns of 2.4G Wi-Fi and 5G Wi-Fi that are both forward radiation patterns.

Although the radiation pattern of 2.4G Wi-Fi of the antenna unit 100 has the characteristic of forward radiation because of cooperation of the first radiation metal element 110 and the second radiation metal element 120, it is difficult for the radiation pattern of 2.4G Wi-Fi to have high directivity owing to the limitation of an area of the ground plane 180 (35 mm×35 mm). In order to improve the antenna performance of 2.4G Wi-Fi, it is typically necessary to increase the area of the ground plane 180 to approximately 45 mm×45 mm (approximately half the wavelength of 2.4G Wi-Fi). According to one embodiment of the present disclosure, the third radiation metal element 130 of the antenna unit 100 may serve as an extension ground plane. In other words, without increasing the area of the ground plane 180 on the bottom of the antenna unit 100, a high-directivity radiation pattern of the 2.4G Wi-Fi can be realized.

The third radiation metal element 130 is a closed loop that surrounds the first radiation metal element 110 and the second radiation metal element 120 and has a fourth ground point G4. The ground point G4 is electrically connected to the ground plane 180 on the bottom. In FIG. 1A, the third radiation metal element 130 is a rectangular loop with width w, where width w is, for example, 1.3 mm. The ground point G4 is disposed on one side of the antenna unit 100 adjacent to the signal feed point F. A distance d between the ground point G4 and a lower left corner of the antenna unit 100 is, for example, 14 mm.

It should be understood that a shape of the third radiation metal element 130 is not limited according to the present disclosure. In practical applications, the third radiation metal element 130 may be any radiation metal element in a symmetrical shape or in an irregular shape that has the effect of extending the ground plane. In addition, although the third radiation metal element 130 is disposed on a top of the antenna unit 100 (on the first substrate 150) according to the present embodiment, the third radiation metal element 130 may be disposed on sides of the antenna unit 100, that is, disposed on sides of the first substrate 150, the second substrate 160, or/and the third substrate 170.

Figure 3:
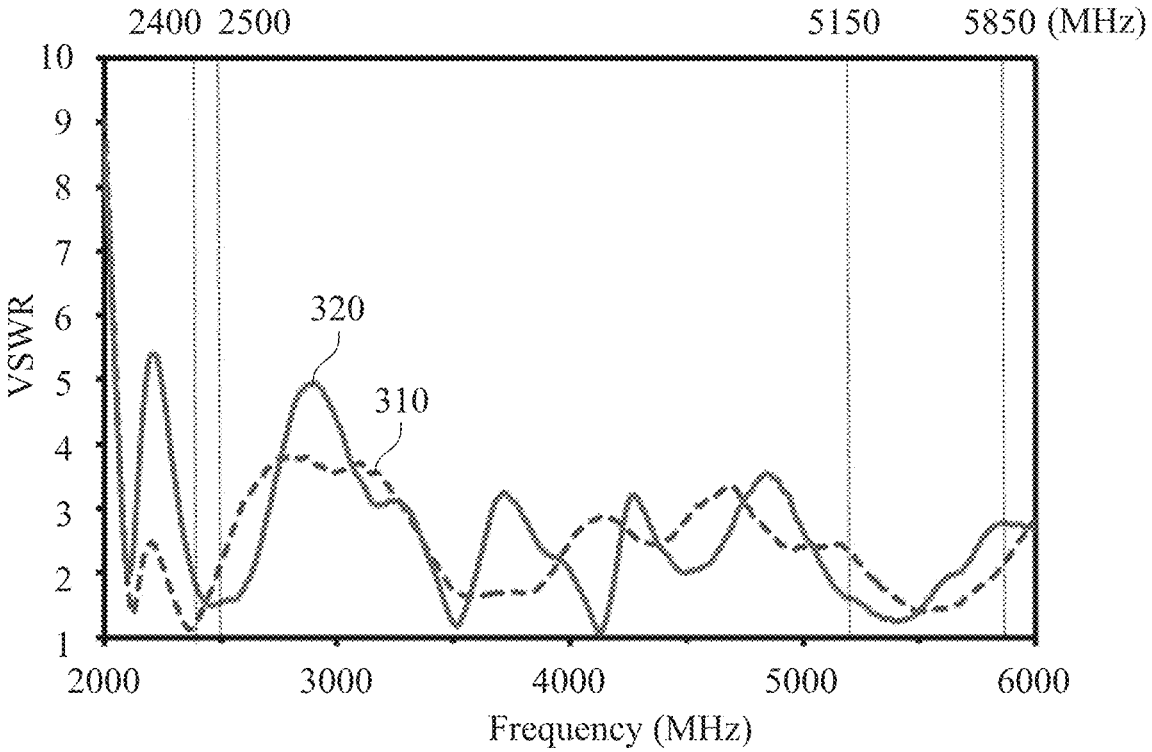
FIG. 3 depicts a relational diagram between a voltage standing wave ratio (VSWR) and a frequency according to one embodiment of the present disclosure.

Through the electrical connection of the ground point G4 and the ground plane 180, the third radiation metal element 130 serves as the extension ground plane of the antenna unit 100 and resonates with the first radiation metal element 110. The radiation pattern of 2.4G Wi-Fi thus has the characteristic of high directivity. FIG. 3 depicts a relational diagram between a voltage standing wave ratio (VSWR) and a frequency of the antenna unit 100 according to one embodiment of the present disclosure. A line segment 310 indicates a relation between a VSWR and a frequency when the antenna unit 100 has no third radiation metal element 130 as the extension ground plane, and a line segment 320 indicates a relation between a VSWR and a frequency when the antenna unit 100 has the third radiation metal element 130 as the extension ground plane. As can be seen from FIG. 3, the second radiation metal element 120 will resonate at a frequency of approximately 2100 MHz, and the third radiation metal element 130 will resonate at a frequency of approximately 2550 MHz. These frequencies can assist the resonant frequency band of 2.4G Wi-Fi and improve the bandwidth of 2.4G Wi-Fi to allow 2.4G Wi-Fi to have a directional effect.

A description is provided with reference to Table 1 below:

TABLE 1

| | Without The Third Radiation Metal Element 130 | | With The Third Radiation Metal Element 130 | |
|---|---|---|---|---|
| Frequency (MHz) | Antenna Efficiency (dB) | Maximum Gain (dBi) | Antenna Efficiency (dB) | Maximum Gain (dBi) |
| 2400 | −1.6 | 2.3 | −2.0 | 2.9 |
| 2412 | −1.5 | 2.3 | −1.9 | 3.4 |
| 2422 | −1.5 | 2.4 | −1.8 | 3.4 |
| 2437 | −1.7 | 2.7 | −1.9 | 2.9 |
| 2442 | −1.6 | 2.6 | −1.8 | 2.8 |
| 2450 | −1.6 | 2.5 | −1.7 | 2.8 |
| 2452 | −1.5 | 2.5 | −1.6 | 2.8 |
| 2462 | −1.6 | 2.2 | −1.6 | 2.8 |
| 2484 | −1.8 | 2.0 | −1.8 | 2.7 |
| 2500 | −1.7 | 2.0 | −1.6 | 2.9 |
| 5100 | −1.3 | 5.2 | −1.8 | 5.5 |
| 5150 | −1.5 | 5.2 | −1.7 | 5.9 |
| 5250 | −1.2 | 6.0 | −1.2 | 6.5 |
| 5350 | −1.5 | 5.9 | −1.7 | 6.3 |
| 5470 | −1.2 | 6.0 | −1.8 | 6.0 |
| 5600 | −1.9 | 5.5 | −2.9 | 4.7 |
| 5725 | −2.5 | 4.6 | −2.7 | 4.5 |
| 5850 | −2.5 | 3.6 | −2.7 | 4.1 |
| 5875 | −2.9 | 3.3 | −3.1 | 3.6 |

Antenna efficiencies and maximum gain values of the antenna unit 100 are listed in Table 1. As can be obviously seen from Table 1, antenna efficiencies of 2.4G Wi-Fi (2400 MHz to 2500 MNz) of the antenna unit 100 are all higher than −2 dB, and antenna efficiencies of 5G Wi-Fi (5100 MHz to 5875 MNz) are approximately higher than −3 dB, showing a good performance of the antenna efficiency performance. Additionally, the antenna unit 100 is significantly improved in the 2.4G Wi-Fi antenna gain after the third radiation metal element 130 surrounding the first radiation metal element 110 and the second radiation metal element 120.

Figure 4A:
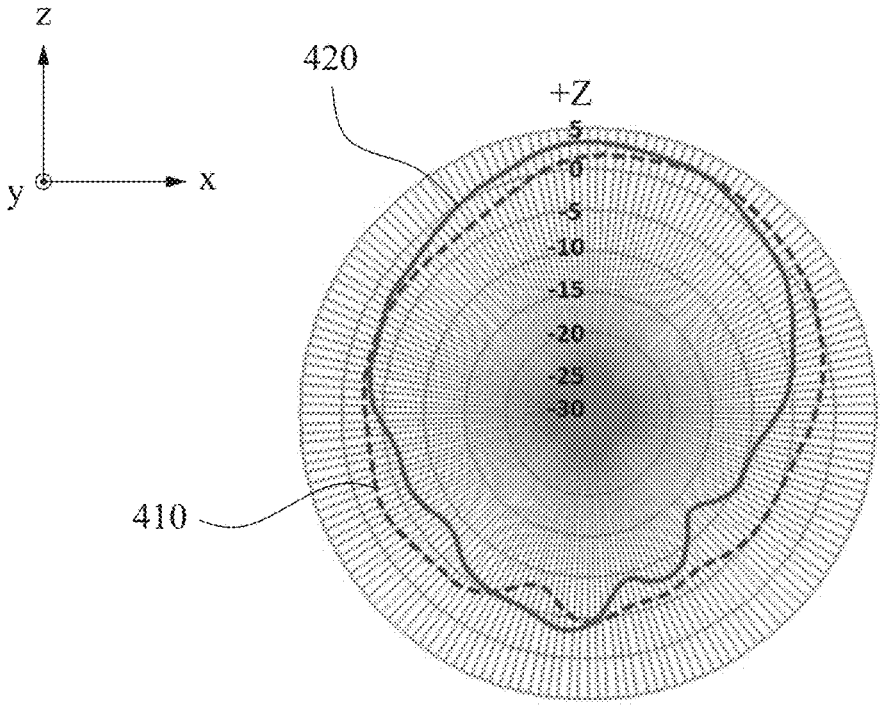
FIG. 4A depicts radiation patterns of an antenna unit according to one embodiment of the present disclosure.
Figure 4B:
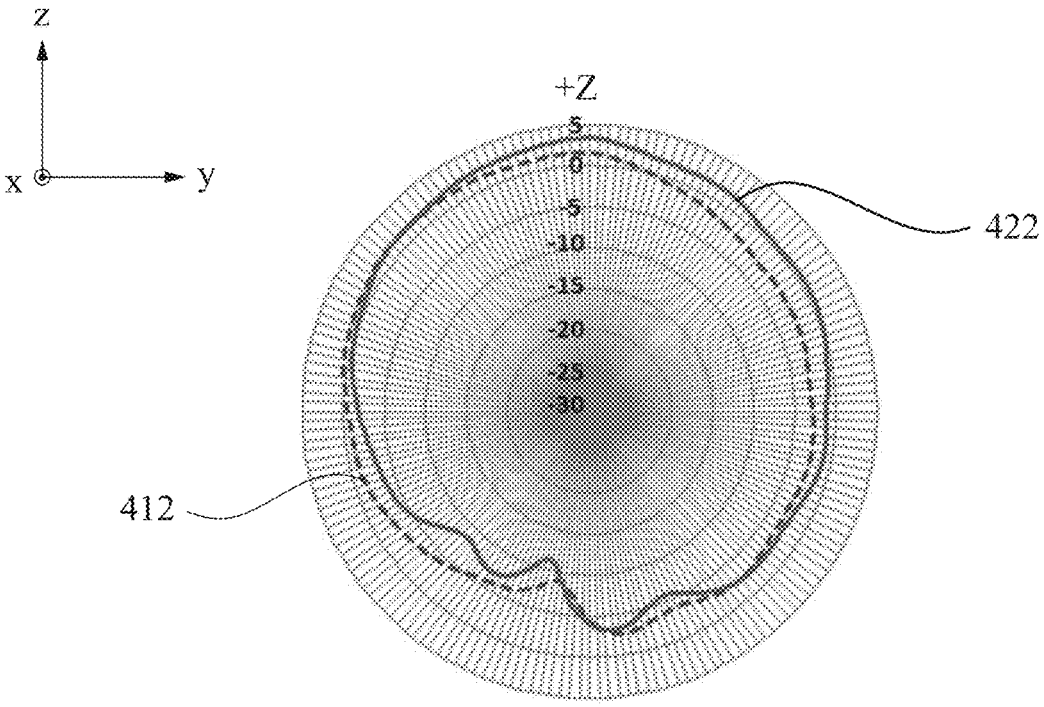
FIG. 4B depicts radiation patterns of an antenna unit according to one embodiment of the present disclosure.

FIG. 4A and FIG. 4B depict radiation patterns of 2.4G Wi-Fi of the antenna unit 100 according to one embodiment of the present disclosure. The top view of the antenna unit 100 depicted in FIG. 1A is on the X-Y plane, and a direction perpendicular to FIG. 1A is the Z direction. A line segment 410 and a line segment 420 in FIG. 4A are radiation patterns of 2.4G Wi-Fi generated on the X-Z plane respectively before and after the third radiation metal element 130 is disposed in the antenna unit 100. A line segment 412 and a line segment 422 in FIG. 4B are radiation patterns of 2.4G Wi-Fi generated on the Y-Z plane respectively before and after the third radiation metal element 130 is disposed in the antenna unit 100. As can be seen from FIG. 4A and FIG. 4B, the radiation patterns of 2.4G Wi-Fi have the characteristics of large forward radiation and small back radiation. In addition, the directivity of radiation patterns of 2.4G Wi-Fi is improved after the third radiation metal element 130 is disposed.

Figure 5:
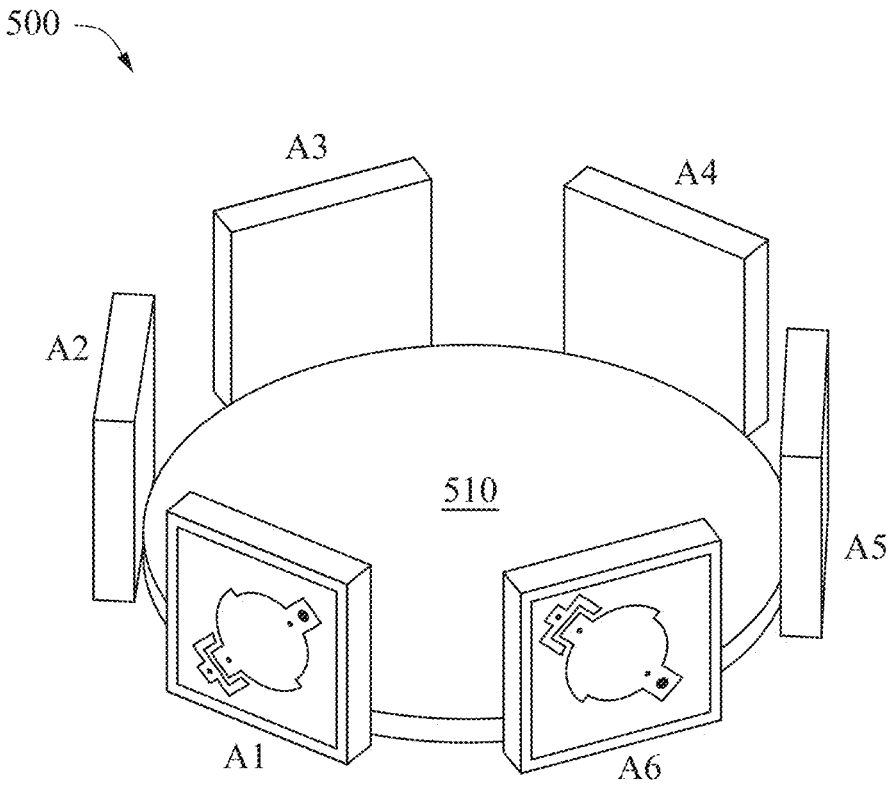
FIG. 5 depicts a schematic diagram of a structure of an antenna system according to one embodiment of the present disclosure.

FIG. 5 depicts a schematic diagram of a structure of an antenna system 500 according to one embodiment of the present disclosure. The antenna system 500 has an antenna array, that are, for example, constituted by antenna units A1-A6 as the antenna units 100, where the detailed structure of each antenna unit may be referred to the description in above paragraphs relevant to the antenna unit 100. It should be understood that in the present embodiment only the six antenna units A1-A6 are taken as an example for illustration, however, the present disclosure is not limited in this regard. In practical application, more or less antenna units may be disposed in the antenna array of the antenna system 500 depending on needs.

The antenna system 500 has a base 510. The base 510 is used for disposing the antenna units A1-A6. Metal radiation elements of the antenna units A1-A6 all face an outside of the antenna system 500 to transmit and receive signals, and each of the metal radiation elements of the antenna units A1-A6 covers a radiation angle of approximately 60 degrees. Directions in which the metal radiation elements of each of the antenna units A1-A6 are disposed are orthogonal to (90 degrees to) directions in which the metal radiation elements of an antenna unit adjacent to the each of the antenna units A1-A6 are disposed so as to be responsible for the vertical and horizontal polarization respectively. For example, a polarization direction of the antenna unit A1 is perpendicular to the polarization directions of the antenna units A2 and A6, and the polarization direction of the antenna unit A2 is perpendicular to the polarization directions of the antenna units A1 and A3, and so on.

It can be inferred from the above that the antenna units A1, A3, A5 have the same polarization direction, and the antenna units A2, A4, A6 have the same polarization direction that is perpendicular to the polarization direction of the antenna units A1, A3, A5. Each of the antenna units A1, A3, A5 is respectively responsible for a radiation angle of approximately 120 degrees and are, for example, a wireless signal in a horizontal/vertical polarization direction, and each of the antenna units A2, A4, A6 is responsible for the radiation angle of approximately 120 degrees and are, for example, a wireless signal in a vertical/horizontal polarization direction.

Figure 6:
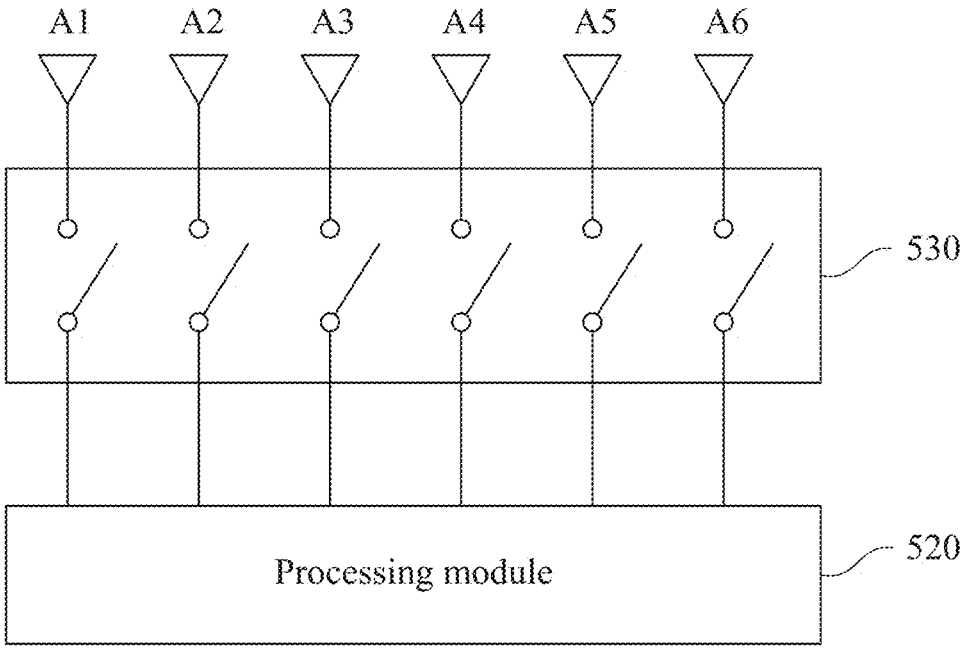
FIG. 6 depicts a schematic diagram of a processing architecture of an antenna system according to one embodiment of the present disclosure.

From the above embodiments, the antenna system 500 further has a processing module 520, as shown in FIG. 6. FIG. 6 depicts a schematic diagram of a processing architecture of an antenna system 500 according to one embodiment of the present disclosure. The processing module 520 may be integrated into the base 510 or disposed outside the antenna system 500 so as to control on and off or operation of each of the antenna units A1-A6 by, for example, electrically connection. In greater detail, the processing module 520 is, for example, a processor, which can control a switch unit 530 through a switch control table, so as to control an on/off state or an operation state of each of the antenna units A1-A6. The switch unit 530 may be a mechanical switch or may be implemented by using a transistor.

An example of the switch control table is as Table 2 below:

TABLE 2

| | | Antenna Unit | | | | | |
|---|---|---|---|---|---|---|---|
| State | Configuration | A1 | A2 | A3 | A4 | A5 | A6 |
| Receive | $M_1$ | off | on | off | on | Off | on |
| | $M_2$ | on | off | on | off | On | off |
| Transmit | $M_3$ | off | on | off | on | Off | on |
| | $M_4$ | on | off | on | off | On | off |
| | $M_5$ | off | on | off | on | Off | on |
| | $M_6$ | off | on | off | on | On | off |
| | $M_7$ | off | on | on | off | On | off |
| | $M_8$ | on | off | on | off | On | off |

TABLE 2-continued

| | | Antenna Unit | | | | | |
|---|---|---|---|---|---|---|---|
| State | Configuration | A1 | A2 | A3 | A4 | A5 | A6 |
| | $M_9$ | on | off | on | off | Off | on |
| | $M_{10}$ | on | off | off | on | Off | on |

In Table 2, "on" indicates that the antenna unit is turned on or active, and "off" indicates that the antenna unit is turned off or inactive. For example, when the antenna system 500 is switched to a configuration $M_1$ by the processing module 520, the antenna units A1, A3, A5 are turned off (off) and the antenna units A2, A4, A6 are turned on (on). In this table, only ten combinations that are configurations $M_1$ to $M_{10}$ are listed, which is merely illustrative and not intended to limit the present disclosure.

When the antenna system 500 is in a signal receiving state, the processing module 520 can switch between the configurations $M_1$, $M_2$, and detect which configuration has a better signal intensity. After a determination is made, the processing module 520 uses the configuration having the better signal intensity to receive signals. Similarly, when the antenna system 500 is in a signal transmitting state, the processing module 520 can switch the configurations $M_3$ to $M_{10}$ by turns and detect which configuration has a better signal intensity. After a determination is made, the processing module 520 uses the configuration having the better signal intensity to transmit signals.

By using the switch control table to perform switching of the antenna units, the antenna system 500 does not need to activate all the antenna units at all times, but only uses the antenna combination with the best efficiency to transmit and receive signals, not only reduce the system power consumption, but also to achieve the performance of dual frequency smart beam switching antenna. In addition, since the antenna array constituted by, for example, a plurality of antenna units 100 is used, interferences caused by back radiation of the antenna system 500 is less. In addition to that, not only 2.4G Wi-Fi but also 5G Wi-Fi can be equipped with the characteristic of high directivity because the third radiation metal element 130 is used. Since each antenna units 100 in the antenna system 500 will have an antenna pattern with high-directivity toward its forward radiation, the each antenna unit 100 will induce less interference to adjacent antenna units.

Figure 7:
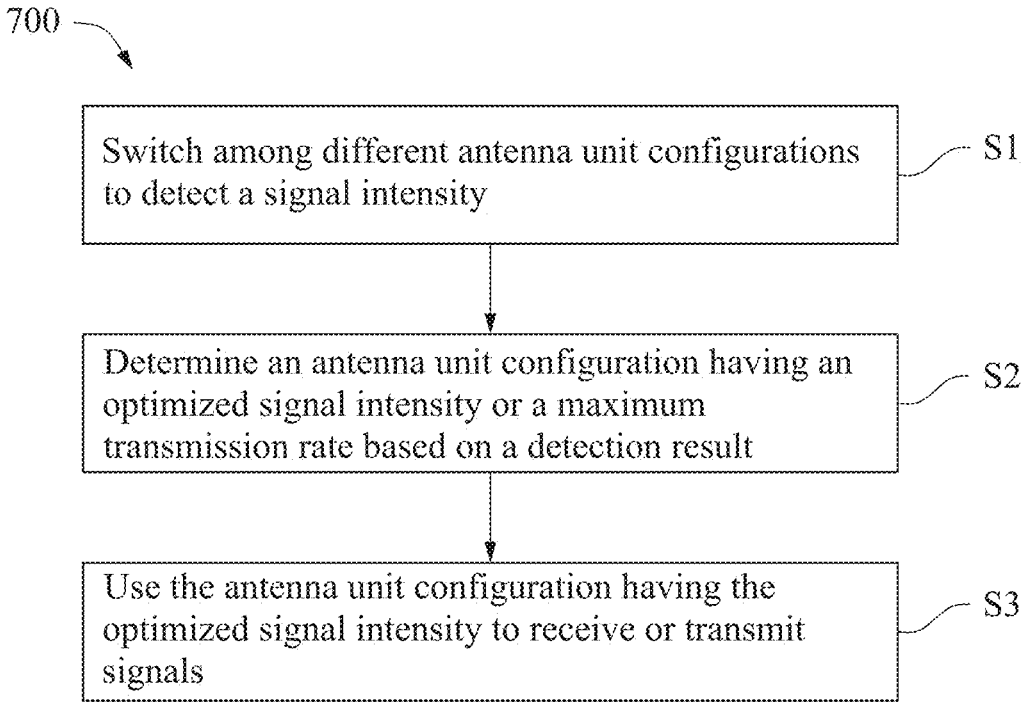
FIG. 7 depicts a flowchart of a control method of an antenna system according to one embodiment of the present disclosure.

FIG. 7 depicts a flowchart of a control method 700 of the antenna system 500 according to one embodiment of the present disclosure. The control method 700 has steps S1 to S3. In step S1, the processing module 520 of the antenna system 500 controls an on/off state of each of the antenna units A1-A6 to switch among a plurality of antenna unit configurations (such as the configurations $M_1$ to $M_{10}$), so as to detect a signal intensity of each of the antenna unit configurations. In step S2, the processing module 520 determines an antenna unit configuration having an optimized signal intensity or a maximum transmission rate based on a detection result. In step S3, the processing module 520 switches an antenna array to the antenna unit configuration that is determined to have the optimized signal intensity in step S2 to start to receive or transmit signals.

Although the present invention has been described in considerable detail with reference to certain embodiments thereof, other embodiments are possible. Therefore, the spirit and scope of the appended claims should not be limited to the description of the embodiments contained herein.

It will be apparent to those skilled in the art that various modifications and variations can be made to the structure of the present invention without departing from the scope or spirit of the invention. In view of the foregoing, it is intended that the present invention cover modifications and variations of this invention provided they fall within the scope of the following claims and their equivalents.

What is claimed is:

1. An antenna control method for an antenna system having a plurality of antenna units, the antenna control method comprising:

controlling an on/off state of each of the antenna units to switch among a plurality of antenna unit configurations;

detecting a signal intensity of each of the antenna unit configurations;

determining one of the antenna unit configurations having an optimized signal intensity; and using the one of the antenna unit configurations to receive or transmit signals, wherein the antenna system comprises:

a plurality of antenna units, each of the antenna units having a directional radiation pattern, the antenna units being disposed to surround a center point and each of the directional radiation patterns extending from the center point towards an outside respectively, wherein each of the antenna units comprises:

a first radiation metal element comprising:

a signal feed point;

a first ground point; and a second ground point, positions of the signal feed point, the first ground point, and the second ground point being arranged approximately in a straight line;

a second radiation metal element disposed away from the first radiation metal element with a gap, the second radiation metal element comprising a third ground point; and a third radiation metal element surrounding the first radiation metal element and the second radiation metal element, the third radiation metal element comprising a fourth ground point.

2. The antenna control method of claim 1, wherein the first radiation metal element further comprises:

a first metal part;

a second metal part connected to one side of the first metal part; and a third metal part connected to the first metal part and located on another side opposite to the second metal part;

wherein the signal feed point is disposed at the second metal part, the first ground point is disposed at the second metal part or the first metal part adjacent to the second metal part, the second ground point is disposed at the third metal part or the first metal part adjacent to the third metal part, and the second radiation metal element is disposed away from the third metal part with the gap.

3. The antenna control method of claim 1, wherein polarization directions of any two adjacent antenna units of the antenna units are orthogonal to each other.

4. The antenna control method of claim 1, the antenna system further comprising:

a processing module configured to control an on/off state of each of the antenna units and detect a signal intensity received by or transmitted from the antenna system.

* * * * *